US005614886A

United States Patent [19]

Snell et al.

[11] Patent Number: 5,614,886

[45] Date of Patent: Mar. 25, 1997

[54] ARTICLE REMOVAL ALARM SYSTEM FOR USE WITH PORTABLE ELECTRONIC DEVICE

[76] Inventors: Peter Snell, 4890 Coronado Ave., San Diego, Calif. 92107; Alfred Fischer, 2202-A Pacific Ave., Costa Mesa, Calif. 92627

[21] Appl. No.: 543,195

[22] Filed: Oct. 13, 1995

[51] Int. Cl.[6] ..... G08B 13/16

[52] U.S. Cl. ..... 340/571; 340/531; 340/568

[58] Field of Search ..... 340/571, 568, 340/531

[56] References Cited

U.S. PATENT DOCUMENTS 4,593,273 6/1986 Narcisse ..... 340/571

4,870,405 9/1989 Fletcher ..... 340/568

5,309,144 5/1994 Lacombe et al. ..... 340/331

*Primary Examiner*—Glen Swann

*Attorney, Agent, or Firm*—Cooley Godward LLP

[57] ABSTRACT

An article removal alarm system includes a base unit for generating an ultrasonic signal for transmission in the vicinity of the base unit. A remote unit accompanying an associated article includes a receiver for receiving the ultrasonic signal. A threshold detector provides a threshold signal upon failure of the receiver to receive the ultrasonic signal at predetermined strength. An alarm unit then generates an alarm signal in response to the threshold signal. In a particular implementation the system enables monitoring of the proximity of a stylus or other input utensil to a responsive user interface of an electronic device.

19 Claims, 5 Drawing Sheets

ARTICLE REMOVAL ALARM SYSTEM FOR USE WITH PORTABLE ELECTRONIC DEVICE

BACKGROUND OF THE INVENTION

1. Field of the Invention

The present invention relates generally to article monitoring devices, and in particular to a system for detecting the removal of an article from within the vicinity of a base unit.

2. Description of the Related Art

Many systems and devices have been developed in an effort to detect the passage of persons and articles from beyond predetermined boundaries. For example, U.S. Pat. No. 4,593,273 (the '273 patent) describes an out-of-range monitor and alarm system that may be used to alert an operator or attendant that a supervised person has walked beyond a prescribed distance. The system of the '273 patent includes a base unit which preferably includes a radio transmitter having an approximately known maximum range to a sensitive receiver within a mobile unit carried by the supervised person. The receiver is disposed to produce an output signal whenever the detected radio frequency (RF) signal from the base unit falls below a predetermined level. In response, a transmitter within the mobile unit sends a signal to the base unit, which in turn sounds an alarm indicating that the supervised person has exceeded the prescribed range from the base unit.

Notwithstanding the existence of this and other RF proximity sensing systems, there remains a need for sensing/alarm devices and systems configured for particular applications. For example, existing RF proximity sensing and other alarm systems would in many ways be unsatisfactory if used to monitor small, inexpensive articles, such as hand-held writing instruments.

The expense of equipping a pen or other writing instrument with an RF transmitter and receiver may also substantially exceed the cost of the writing instrument or the like being monitored. RF systems also require utilization of an antenna, which would be impracticable in applications involving small writing instruments. In addition, the considerable power requirements of RF systems tend to render battery life unacceptably low for such applications. Finally, RF systems are subject to regulation by the Federal Communications Commission (FCC), thereby further complicating the design process. In addition, since RF energy penetrates most walls and doors, these monitoring systems are not disposed to monitor the removal of articles from an enclosed area such as a room.

U.S. Pat. No. 4,870,405 provides an alternative to RF-type systems for monitoring objects such as writing instruments. Specifically, removal of an object from a base receptacle initiates a timing cycle. At the conclusion of the timing cycle, an alarm sounds at the base receptacle unless the object has been replaced. However, the fixed duration of the timing cycle precludes accommodation of different intervals of use of the object or writing instrument. In this regard the setting the timing cycle to be of a relatively low duration (to ensure prompt notification of unauthorized object removal) may result in undesired sounding of the alarm during extended periods of authorized use.

The advent of various personal electronic devices, such as so-called "personal digital assistants", has also created a need for an inexpensive article monitoring system. In particular, it would be desirable to provide a cost-effective way to monitor the proximity of a stylus or other user input utensil to the electronic base unit. If the monitoring system were further configured with some form of alarm, the likelihood of inadvertent removal of the stylus from the vicinity of the electronic base unit would be substantially diminished. Given that certain personal electronic devices are being designed for wireless communication with a host system, the potential for radio interference renders RF-type monitoring systems even less preferable for such applications.

Accordingly, a need in the art exists for an article monitoring system which allows for flexible periods of authorized use, and which avoids the aforementioned shortcomings of RF sensing and detection techniques.

SUMMARY OF THE INVENTION

The present invention is directed to alarm system for generating an alarm signal upon removal of an article from the vicinity of a base unit. The article removal alarm system includes a base unit for generating an ultrasonic signal for transmission in the vicinity the base unit. A remote unit accompanying the article includes a receiver for receiving the ultrasonic signal. A threshold detector provides a threshold signal upon failure of the receiver to receive the ultrasonic signal at predetermined strength. An alarm unit then generates an alarm signal in response to the threshold signal.

In another aspect, the present invention may be used in conjunction with an electronic device having a user interface designed to be responsive to a stylus or other input utensil. In this implementation the alarm system is configured to generate an alarm signal upon removal of the user input utensil from the vicinity of the electronic device. The alarm system includes an ultrasonic transmitter, disposed in the electronic device, for generating an ultrasonic signal. A remote unit, accompanying the user input utensil, includes a receiver for receiving the ultrasonic signal. A threshold detector provides a threshold signal upon failure of the receiver to receive the ultrasonic signal at a predetermined strength. The remote unit further includes an alarm unit for generating an alarm signal in response to the threshold signal.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
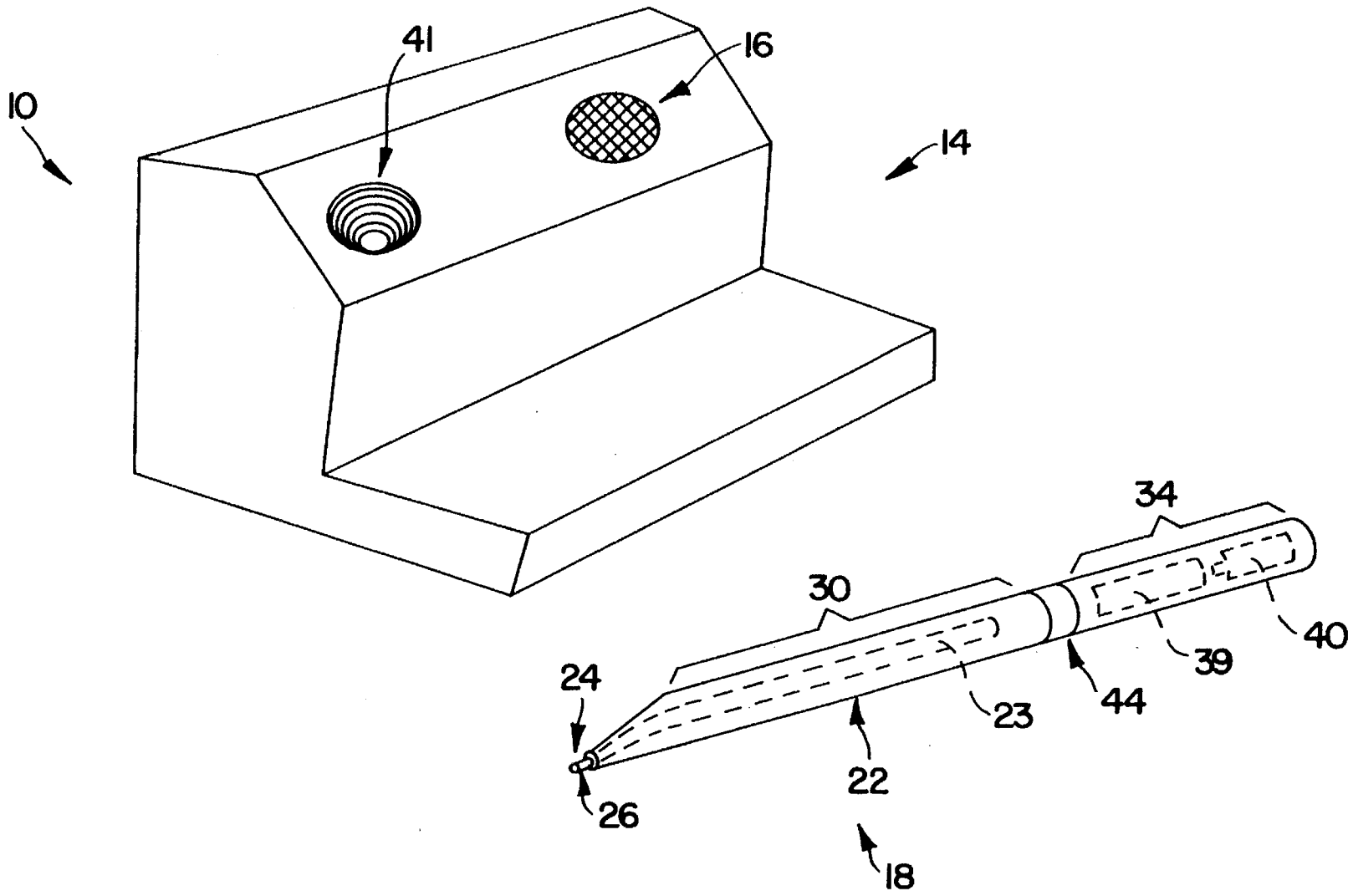
FIG. 1 shows a base unit and a portable unit included within an exemplary embodiment of the article removal alarm system of the present invention.

Referring to FIG. 1, a preferred embodiment of an article removal alarm system 10 of the present invention includes a base unit 14 having an ultrasonic transmitter (not shown in FIG. 1) operative to transmit an ultrasonic signal through a meshed cover 16. The ultrasonic signal will typically be transmitted continuously throughout the area surrounding the base unit 14. Mounted upon the base unit 14 may be a small notepad (not shown) or the like.

The article removal system 10 also includes a portable unit 18 having a housing 22 adapted to hold a pen 23 or other writing instrument. In this regard the housing 22 defines a small circular aperture 24 through which protrudes a tip 26 of the pen 23. The housing 22 includes a first compartment 30 in which is disposed the pen 23 (shown in phantom), and a second compartment 34 designed for enclosure of an ultrasonic receiver module 38 and battery 40 (both also shown in phantom). A cylindrical wire screen or mesh 44, interposed between first and second sections 30 and 34 of the housing 22, allows the ultrasonic signal transmitted by the base unit 14 to reach the ultrasonic receiver module 38. When the pen 23 is not being used, the portable unit 18 may be placed within a receptacle 41 defined by the base unit 14. Alternately, the ultrasponic signal from the base unit 14 may reach the receiver module 38 through an end aperture (not shown) defined by housing 22.

The ultrasonic receiver module 38 includes a threshold circuit (not shown) operative to produce a predefined voltage output level when the detected ultrasonic signal from the base unit 14 falls below a predetermined level. In the exemplary embodiment this results in actuation of an audible alarm within the portable unit 18, it being understood that other alarm indications (e.g., flashing light) could also be provided. The threshold circuit is set to generate the predefined voltage output level, and hence trigger the audible alarm, upon movement of the portable unit 18 beyond a predetermined distance (e.g., 15 feet) from the base unit 14.

Because the signal transmitted by the base unit 14 is ultrasonic, movement of the portable unit 18 which causes it to become separated from the base unit 14 by a wall or door will also generally result in actuation of the audible alarm. Hence, movement of the portable unit 18 immediately outside of a room within which is disposed the base unit 14 will tend to trigger the alarm. Since it will typically be desired that users of the pen or other instrument within the portable unit 18 remain within the same room as the base unit 14, the use of ultrasonic energy is seen to advantageously enable detection of movement of the portable unit out of an enclosed area. This contrasts with monitoring systems employing RF energy, which are relatively insensitive to movement of a monitored object beyond walls and doors.

Figure 2:
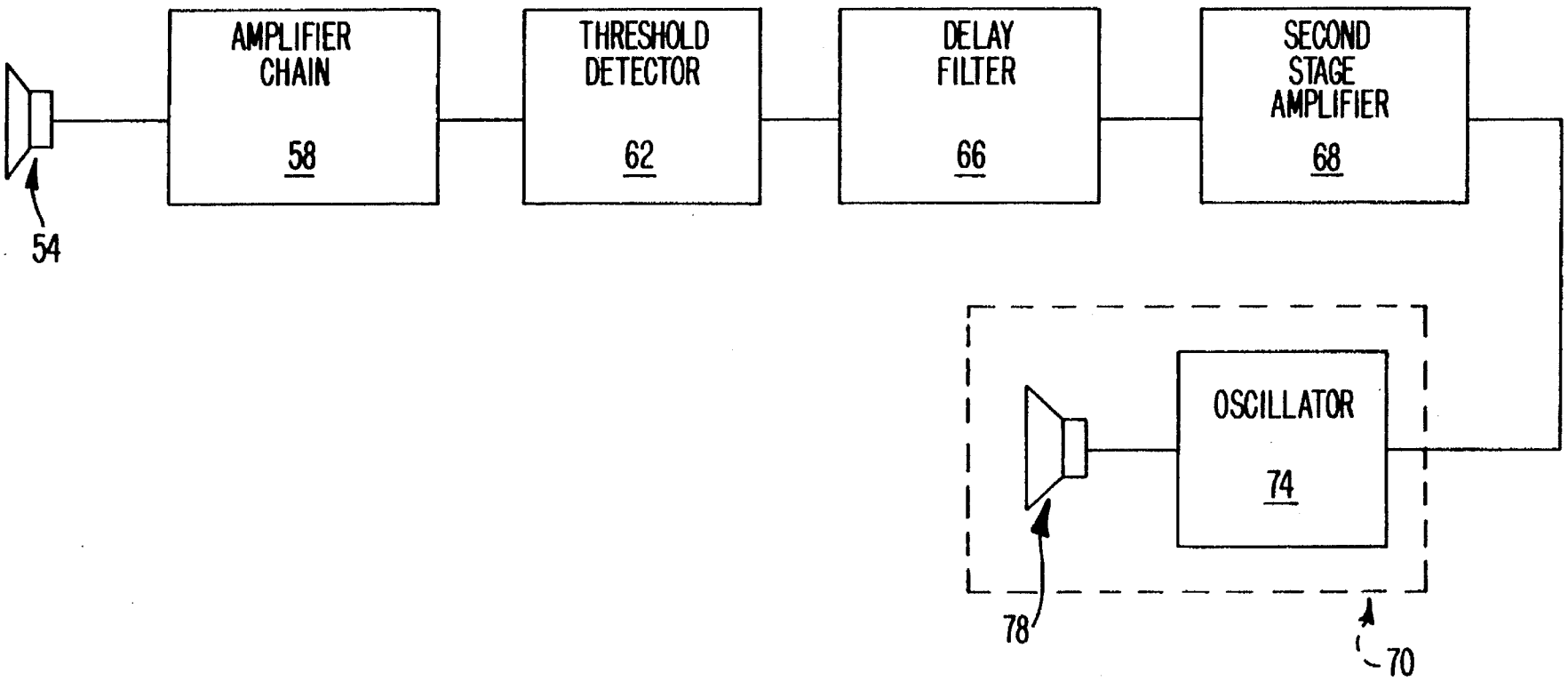
FIG. 2 provides a block diagram of an ultrasonic receiver module and audible alarm unit included within the portable unit.

FIG. 2 provides a block diagram of the ultrasonic receiver module 38 and an audible alarm unit 70. The receiver module 38 includes an ultrasonic microphone 54 for generating an electrical signal in response to ultrasonic signal energy received from the base unit 14. The electrical signal is amplified within an amplifier chain 58, and provided to a threshold detector 62. When the magnitude of the amplified electrical signal produced by the amplifier chain 58 falls below an adjustable threshold, the output of the threshold detector 62 changes to a predefined level. A delay filter 66 is designed to prevent spurious changes in the output of the threshold detector 62, occurring in response to brief interruption of the received ultrasonic signal, from triggering an audible alarm unit 70. After passing through the delay filter 66, the filtered electrical signal is amplified by a second stage amplifier 68 prior to being supplied to the audible alarm unit 70.

As is indicated by FIG. 2, the audible alarm unit 70 includes an active RC oscillator 74 designed to oscillate at a predefined frequency (e.g., 4 KHz) when the output of the threshold detector 62 changes to the requisite predefined level. An audio transducer 78 functions to generate an audible signal in response to oscillation of the active RC oscillator 74.

Figure 3:
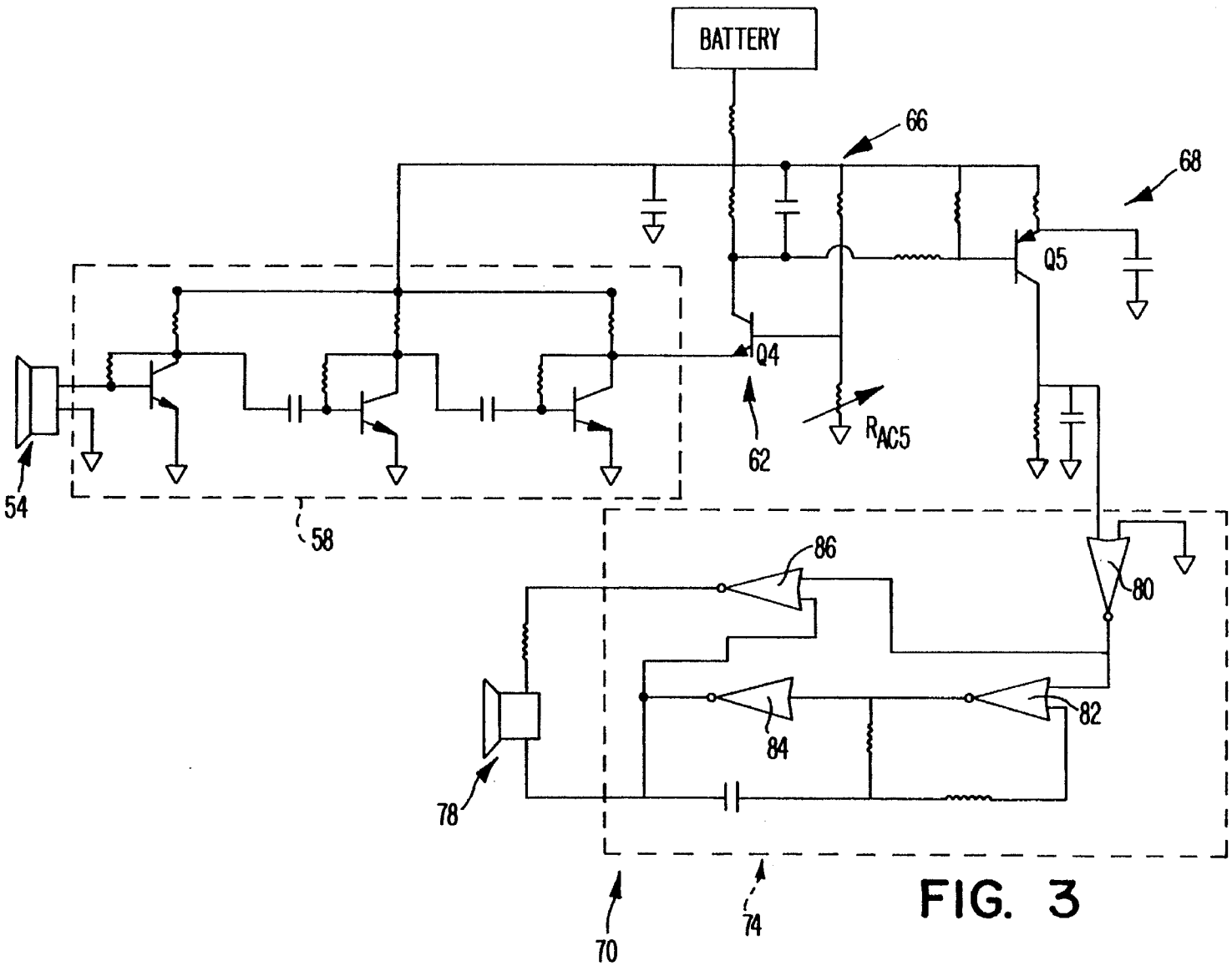
FIG. 3 provides a detailed schematic representation of the ultrasonic receiver module and audible alarm unit.

FIG. 3 provides a detailed schematic representation of the receiver module 38 and audible alarm unit 70. In the embodiment of FIG. 3 the threshold detector 62 comprises an NPN transistor Q4 having a base terminal biased at approximately one-half of the available voltage supply. The resistance of a threshold adjustment resistor ($R_{ADJ}$) may be adjusted in order to alter the threshold received signal level at which the alarm unit 70 is actuated. The collector of NPN transistor Q4 is operatively coupled to the base of a PNP transistor Q5 used to implement the second stage amplifier 68. As is indicated by FIG. 3, the collector of the PNP transistor Q5 drives one input of a first 80 of four NOR gates (80, 82, 84, 86) included within a standard 74HC02 integrated circuit (I.C.) used to realize the active RC oscillator 74.

Figure 4:
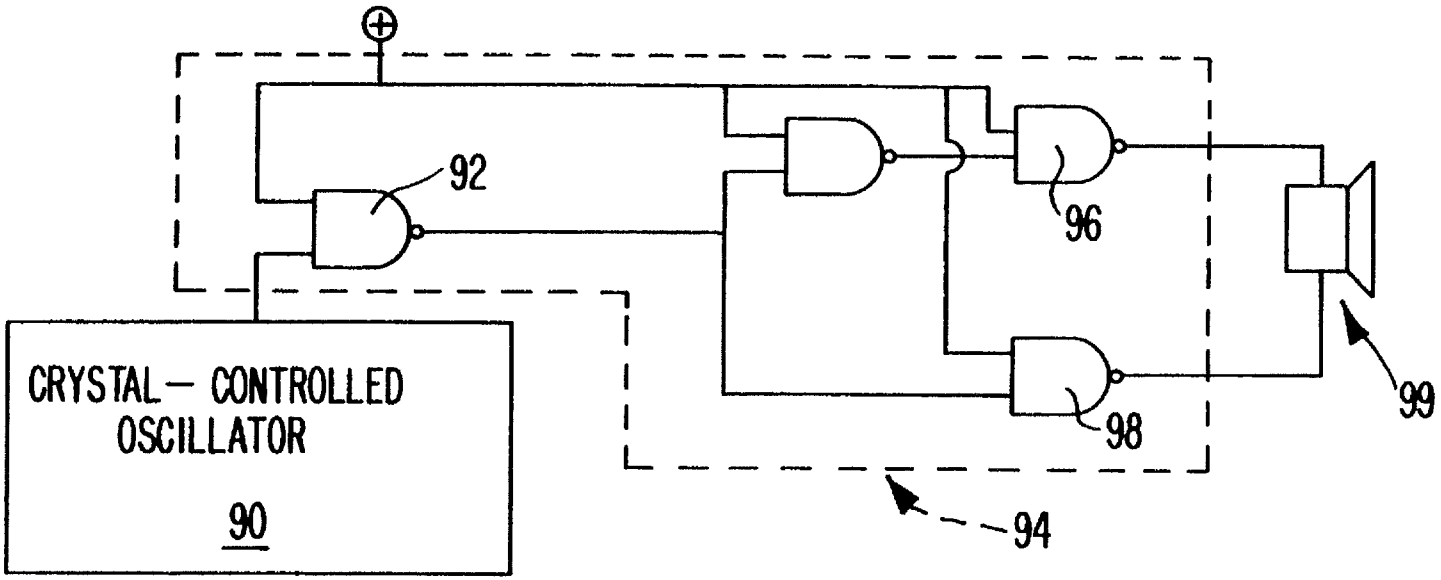
FIG. 4 shows an exemplary implementation of an ultrasonic transmitter within the base unit.

Turning now to FIG. 4, in an exemplary implementation the ultrasonic transmitter within the base unit 14 includes a crystal-controlled oscillator 90 tuned to oscillate at a predefined ultrasonic frequency (e.g., 40 KHz). The crystal-controlled oscillator 90 is coupled to a first port of a first NAND gate 92 included within a standard 4-input 74HC00 I.C. 94. A pair of output NAND gates (96, 98) of the 4-input 74HC00 I.C. 94 are seen to drive an ultrasonic transducer 99 responsible for transmitting the ultrasonic energy received by the portable unit 18.

Figure 5:
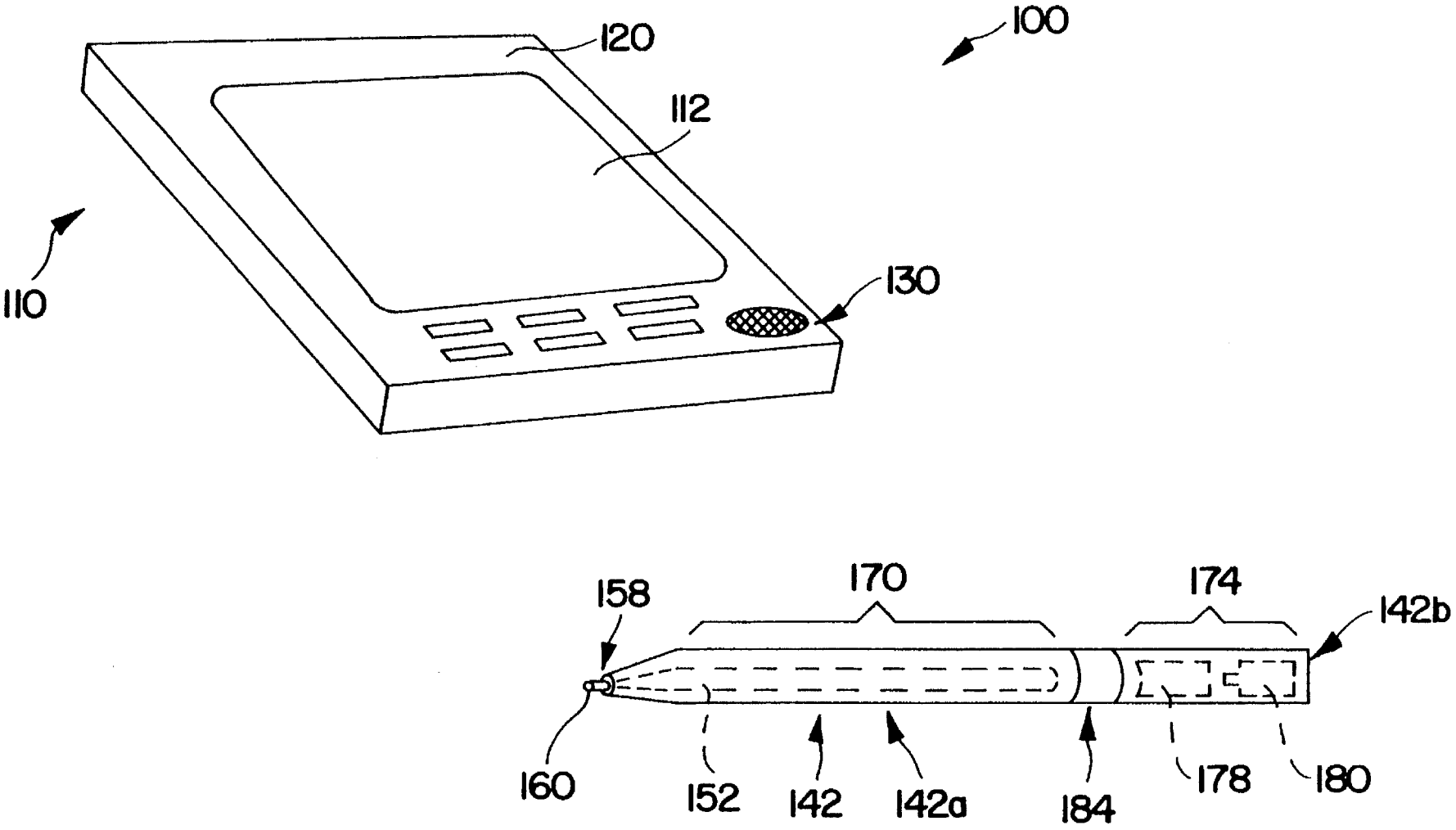
FIG. 5 depicts an article removal alarm system designed for incorporation within a personal electronic device.

Referring now to FIG. 5, in an alternately preferred embodiment of an article removal alarm system 100 of the present invention the base unit ultrasonic transmitter is included within a personal electronic device 110. The personal electronic device 110 may comprise, for example, a personal digital assistant or the like having a user interface responsive to a user input utensil such a stylus. Such a user interface could comprise, for example, a touch-sensitive or light-sensitive interface screen 112. The ultrasonic transmitter may be realized as in FIG. 4, but will transmit ultrasonic energy from within a housing 120 of the electronic device 110 through a meshed aperture 130.

The system 100 also includes a portable unit 140 having a housing 142 adapted to hold a stylus 152 or other user input utensil designed for utilization with the interface screen 112. The housing 142 defines a small circular aperture 158 through which protrudes a tip 160 of the stylus 152. The housing 142 includes a first compartment 170 in which is disposed the stylus 152, and a second compartment 174 designed for enclosure of an ultrasonic receiver module 178 and battery 180. A cylindrical wire screen or mesh 184, interposed between first and second sections **142*a* and 142*b* of the housing 142, allows the ultrasonic signal transmitted by the ultrasonic transmitter within the electronic device 110 to reach the ultrasonic receiver module 178. The ultrasonic receiver module 178 is designed to operate in a manner substantially identical to that of the receiver module 38 (FIGS. 1 and 2). That is, an audible alarm circuit within the portable unit 140 will generate an audible alarm when the ultrasonic energy received by the receiver module 178** falls below a predetermined threshold.

The previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Thus, the present invention is not intended to be limited to the embodiments shown herein but is to be accorded the widest scope consistent with the principles and novel features disclosed herein.

What is claimed is:

1. An alarm system for generating an alarm signal upon removal of an article from the vicinity of a base unit, said alarm system comprising:

a base unit for generating an ultrasonic signal for transmission into said vicinity of said base unit; and a remote unit accompanying said article, said remote unit including:

a receiver for receiving said ultrasonic signal, a threshold detector for providing a threshold signal upon failure of said receiver to receive said ultrasonic signal at predetermined strength, and means for generating an alarm signal in response to said threshold signal.

2. The alarm system of claim 1 wherein said remote unit includes a housing configured to hold said article.

3. The alarm system of claim 2 wherein said receiver is disposed within a first compartment of said housing, and wherein said article is disposed within a second compartment of said housing.

4. The alarm system of claim 3 wherein said housing defines at least one aperture through which may pass said ultrasonic signal.

5. The alarm system of claim 2 wherein said base unit includes a receptacle in which may be placed said housing when said article is not in use.

6. The alarm system of claim 1 further including means for calibrating said threshold detector to provide said threshold signal upon received strength of said ultrasonic signal falling below a predetermined level.

7. The alarm system of claim 1 wherein said remote unit includes a housing in which is disposed said receiver, said housing defining at least one aperture through which said ultrasonic signal may pass to said receiver.

8. The alarm system of claim 1 wherein said article comprises a writing instrument disposed within a housing of said remote unit, said housing defining an aperture through which said writing instrument at least partially protrudes.

9. The alarm system of claim 1 wherein said receiver includes filter means for inhibiting said threshold signal from being provided in response to spurious interruption of said ultrasonic signal.

10. A method for alarming a remote unit accompanying an article upon removal of the article from the vicinity of a base unit, said method comprising the steps of:

generating an ultrasonic signal at said base unit which emanates into the vicinity of said base unit;

receiving, at said remote unit, said ultrasonic signal;

providing a threshold signal upon failure to receive said ultrasonic signal at predetermined strength; and generating an alarm signal at said remote unit in response to said threshold signal.

11. The method of claim 10 further including the step of:

providing in said remote unit a first compartment in which is disposed said article, and a second compartment in which is disposed an audio transducer for generating said alarm signal.

12. A method for alarming a remote unit accompanying an article upon removal of the article from the vicinity of a base unit, said remote unit including a housing in which is disposed said article, said method comprising the steps of:

generating an ultrasonic signal at said base unit which emanates into the vicinity of said base unit;

receiving, at said remote unit, said ultrasonic signal;

providing a threshold signal upon failure to receive said ultrasonic signal at predetermined strength; and generating an audible alarm signal at said remote unit in response to said threshold signal.

13. The method of claim 12 further including the step of:

providing in said housing a first compartment in which is disposed said article, and a second compartment in which is disposed an audio transducer for generating said audible alarm signal.

14. In a system including an electronic device having a user interface responsive to a user input utensil, an alarm system for generating an alarm signal upon removal of said user input utensil from the vicinity of said electronic device, said alarm system comprising:

means for generating an ultrasonic signal for transmission into the vicinity of said electronic device; and a remote unit accompanying said user input utensil, said remote unit including:

a receiver for receiving said ultrasonic signal, a threshold detector for providing a threshold signal upon failure of said receiver to receive said ultrasonic signal at predetermined strength, and means for generating an alarm signal in response to said threshold signal.

15. The alarm system of claim 14 wherein said remote unit includes a housing in which is disposed said user input utensil.

16. The alarm system of claim 15 wherein said receiver is disposed within a first compartment of said housing, and wherein said user input utensil is disposed within a second compartment of said housing.

17. The alarm system of claim 14 further including means for calibrating said threshold detector to provide said threshold signal upon received strength of said ultrasonic signal falling below a predetermined level.

18. The alarm system of claim 14 wherein said alarm signal comprises an acoustic signal.

19. The alarm system of claim 14 wherein said user input utensil comprises a stylus disposed within a housing of said remote unit, said housing defining an aperture through which said stylus may interact with a screen of said user interface.

* * * * *